United States Patent [19]

De Vincentis

[11] Patent Number: 5,027,519

[45] Date of Patent: Jul. 2, 1991

[54] CUE TIP DRESSING DEVICE AND METHOD

[76] Inventor: Scott A. De Vincentis, 4117 Wilson Rd., Kenosha, Wis. 53142

[21] Appl. No.: 421,774

[22] Filed: Oct. 16, 1989

[51] Int. Cl.[5] ..... B27L 9/00

[52] U.S. Cl. ..... 30/494; 29/78

[58] Field of Search ..... 30/494; 29/78, 79, 80

[56] References Cited

U.S. PATENT DOCUMENTS

| | | | |
|---|---|---|---|
| 75,049 | 3/1868 | Pernot . | |
| 75,568 | 3/1868 | Nickerson | 29/78 |
| 94,503 | 9/1869 | Nicholson | 29/78 |
| 221,164 | 11/1879 | Fautz . | |
| 284,548 | 9/1883 | Gwyn . | |
| 362,526 | 5/1887 | Mueller . | |
| 445,712 | 2/1891 | Dallis | 29/78 |
| 451,938 | 5/1891 | Klapperich . | |
| 587,016 | 7/1897 | Paine . | |
| 636,199 | 10/1899 | Davies . | |
| 1,021,128 | 3/1912 | Brecker . | |
| 1,259,136 | 3/1918 | Rogers . | |
| 1,297,041 | 3/1919 | Treiber . | |
| 3,728,828 | 4/1973 | Freedman | 51/204 |
| 3,963,237 | 6/1976 | Bushberger | 273/19 |
| 3,989,079 | 11/1976 | Treadway | 145/27 |
| 4,594,782 | 6/1986 | Willard | 30/494 |
| 4,785,586 | 11/1988 | Kratfel | 51/181 R |

FOREIGN PATENT DOCUMENTS

| | | | |
|---|---|---|---|
| 23534 | 11/1921 | France | 30/494 |

*Primary Examiner*—Frederick R. Schmidt
*Assistant Examiner*—M. Rachuba
*Attorney, Agent, or Firm*—Peter N. Jansson, Ltd.

[57] ABSTRACT

An improved cue tip dressing device and method. The device includes a base with a main surface and a plurality of projections from the main surface each of which has front and back surfaces converging to a convex knife edge forming the projection distal end portion. The method includes striking a hardened cue tip with the device to create a pattern of punctures on the tip.

7 Claims, 2 Drawing Sheets

CUE TIP DRESSING DEVICE AND METHOD

FIELD OF THE INVENTION

This invention is related generally to cue tips for billiard sticks and, more particularly, to devices for dressing such cue tips when hardened from use.

BACKGROUND OF THE INVENTION

One of the oldest and most widely understood games and forms of entertainment is billiards, which in its various forms and in different parts of the world includes pool, caroms, and snooker. Improvements have been made in billiards equipment for well over a century.

Billiards involves directional driving of hard balls on a tabletop by hitting them with another hard ball known as the cue ball. The cue ball is directed toward the target balls by striking it with what is known as a cue stick. A cue stick has a cue tip, that is, the portion which engages the cue ball.

Cue tips are made of firm leather or other similar material which is neither too soft nor too hard. When the cue tip is in good condition, it not only can impact a ball with accuracy but, depending on how it is impacted, can impart a spin to the cue ball which is helpful in achieving the intended cue ball motion both before and after the cue ball hits the target ball. When in good condition, cue tips will also receive and hold chalk to help in proper cue tip - cue ball engagement.

A long-standing and very well recognized problem with billiards cue tips is that they become very hard and even shiny after excessive use. As a result they fail to engage the cue ball properly. And, they cannot hold chalk properly very long.

More specifically, hardened and even shiny cue tips tend to slip on the cue ball surface unless the dead center of the cue ball is struck. But it is often highly desirable to strike the cue ball away from, rather than on, its dead center, since striking it in an off-center position will impart desired cue ball spin. This can be very difficult with a hardened and even shiny cue tip.

Furthermore, as noted, a cue tip which is hardened from excessive use does not hold chalk well. The result is that, after chalking, the benefit of the chalk is prematurely gone. Because of this, hardened and shiny cue tips seriously degrade the performance of those using them.

Many inventions and devices have been proposed and used over the last century for the purpose of repairing hardened cue tips and/or otherwise dressing them for continued use. The following United States patents dealing with the subject of dressing billiards cue tips have been issued:

4,785,586 (Kratfel)
4,594,782 (Willard)
3,989,079 (Treadway)
3,963,237 (Bushberger)
3,728,828 (Freedman)
1,297,041 (Trieber)
1,259,136 (Rogers)
1,021,128 (Brecker)
636,199 (Davies)
587,016 (Paine)
451,938 (Klapperich)
362,526 (Mueller)
284,548 (Gwyn)
221,164 (Fautz)
75,049 (Pernot).

Many of such prior patents disclose billiards cue tip dressing devices of the type with non-smooth surfaces for application against hardened cue tips. They disclose scruffing, sanding, or abrading the cue tip surfaces roughen them. To that end, such devices include abrasive compositions, abrasive wheels, file-like serrations, sandpaper, emery cloth, and the like. Such prior patents speak of rubbing the non-smooth surface on the hardened cue tip or spinning the hardened cue tip on such surface.

In many cases, such attempts at cue tip dressing have disadvantages. For example, such cue tip treatments will erode and eventually wear away the cue tip material, rendering the remaining cue tip material useless. And, in many cases such abrading does not improve the condition of the cue tip as much as might be desired, with the result that the cue tip will become hardened again too quickly such that it cannot function well or adequately receive and hold cue chalk.

In short, there is a continuing need for an improved billiards cue tip dressing device and method.

OBJECTS OF THE INVENTION

It is an object of this invention to provide an improved billiards cue tip dressing device and method which overcome some of the problems and shortcomings of the prior art, including those mentioned above.

Another object of this invention is to provide an improved cue tip restoration device and method which allow effective cue ball spinning over extended cue tip life.

Another object of this invention is to provide a cue tip dressing device and method which better and more easily restore cue tips which are hardened from use.

Another object of this invention is to provide a cue tip dressing device and method which restore cue tips without excessive abrasion.

Another object of this invention is to provide a cue tip dressing device and method which restore hardened cue tips without degrading or erosion of the cue tip material.

Another object of this invention is to provide a cue tip dressing device and method which prepare cue tips which were hardened from use for additional use without the need for excessive rechalking.

Another object of this invention is to provide a cue tip dressing device and method which prepare cue tips which were hardened from use to receive and hold chalk more effectively.

These and other important objects will be apparent from the descriptions of this invention which follow.

SUMMARY OF THE INVENTION

The cue tip dressing device of this invention is of the type having a non-smooth surface for application against a hardened cue tip. The device and method of this invention overcome certain problems and shortcomings of prior devices and methods, and achieve the objects of this invention noted above.

The device of this invention is preferably a hard metal implement having a base with a main surface and a plurality of projections extending from the main surface to puncture hardened cue tips. Each projection has a front surface and a back surface which converge to a convex knife edge which forms a distal end portion of the projection.

The device is not stroked against a hardened cue tip surface. Rather, it is used by striking it against such hardened surface. During such action, the projections puncture the hardened tip, creating a pattern of punctures on it. One aspect of this invention is the discovery that puncturing a hardened cue tip is a more effective way of restoring the tip for additional use. Furthermore, by use of this method, the tip is much less likely to be worn away as a powder as can occur from sanding, filing and other abrading actions.

In highly preferred embodiments of this invention, the front and back surfaces of each projection, which converge to form the convex knife edges, are progressively farther apart at positions progressively more remote from the convex knife edge. This serves to impart strength and sturdiness to the projections, making them more effective as puncturing means. This configuration of projection also gives the punctures substantial volume, allowing better departure from the hardened characteristic of the used cue tip and creating space for the restored cue tip to accept and hold chalk more effectively.

In preferred embodiments, the convex knife edge on each projection extends from the main surface of the base through the distal end portion of such projection and back to the main surface of the base. This makes the entire length of the projection effective as a puncturing and cutting means, which allows effective, relatively deep puncturing action.

In highly preferred embodiments of this invention, the front surface and the back surface of each projection are both angled with respect to the main surface of the base in the same direction. This gives the projections undercut profiles, making them effective as puncturing means. Such effectiveness is due in part to the sharpness of such projections.

Such undercut angling is most preferably in a direction toward the grip handle such that the projections have undercut profiles oriented toward the grip handle. This configuration is particularly useful during striking motions involving pivoting of the wrist of the user, that is, during striking motions which are somewhat rotational in nature.

In preferred embodiments, the main surface of the base, from which the projections extend, is convex and has a plurality of rows of projections extending therefrom. A tight pattern of projections and such convexity of the main surface serve to make the restoring operation simple.

In highly preferred embodiments, the device of this invention includes a grip handle which extends from the base. Such handle preferably includes a remote portion spaced from the base and a narrowed portion between the base and the remote portion. Such narrowed portion may be gripped conveniently by an index finger during use, while the thumb of the user applies force to the surface of the base opposite the surface from which the projections extend.

The method of this invention involves supporting a cue stick with its hardened cue tip facing generally upwardly, and striking downwardly on such hardened cue tip with an impact tool like that described to create a pattern of punctures on the cue tip. Thereafter, chalk may be applied in the normal manner to fill the punctures. Such restoration operation is simple and effective, and avoids excessive damage to the cue tip.

DETAILED DESCRIPTIONS OF PREFERRED EMBODIMENTS

Figure 1:
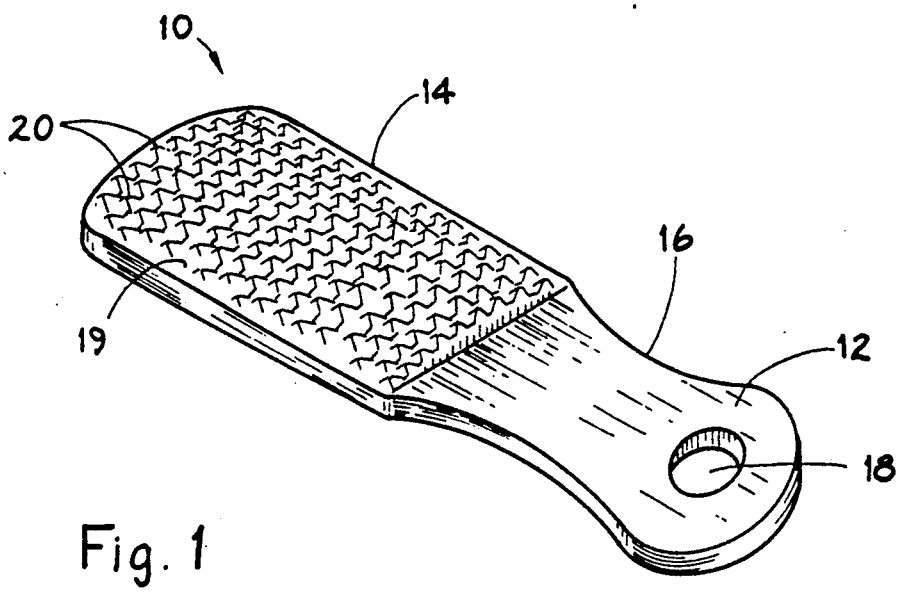
FIG. 1 is an enlarged perspective view of a billiards cue tip dressing device in accordance with this invention.
Figure 2:
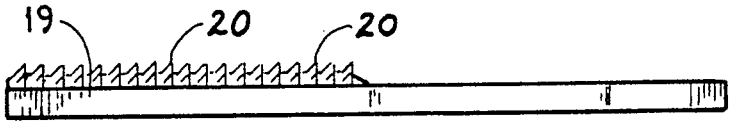
FIG. 2 is a similarly enlarged side elevation.

The drawings show a cue tip dressing device 10 in accordance with this invention. Cue tip dressing device 10 is preferably made of tool steel, and is a generally flat member which includes a grip handle 12 and a working end or base 14.

Grip handle 12 has a relatively wide portion remote from base 14 and, between base 14 and such relatively wide portion, a narrowed portion 16 around which the user's index finger may curl during use of device 10. Grip handle 12 also includes a hole 18 which may be used for hanging, chain attachment, or any other purpose.

Figure 3:
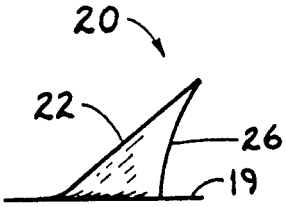
FIG. 3 is a further enlarged side elevation of one projection.
Figure 4:
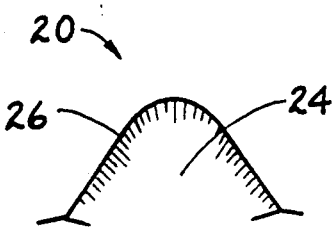
FIG. 4 is a right side elevation of FIG. 3.
Figure 5:
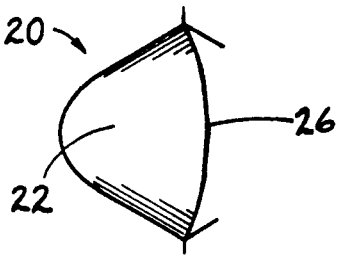
FIG. 5 is a top plan view of FIG. 3.

Base 14 includes a convex main surface 19 from which a plurality of projections 20 extend. Projections 20 are arranged in a plurality of rows across main surface 19. Projections 20 are substantially similar one to the other, and so may be described by reference to one projection 20 as seen in FIGS. 3–5.

Projection 20 includes a front surface 22 and a back surface 24. Each of such surfaces are curved in a direction such that they are convex in a direction away from grip handle 12. Furthermore, front and back surfaces 22 and 24 are each angled in generally the same direction with respect to main surface 19. That is, they are angled toward grip handle 12. Such angling of surfaces 22 and 24 in the same direction makes projection 20 an undercut projection. Projection 20 leans toward handle 12.

Projections 20, rather than having points on their distal end portions, have knife edges 26. Front surface 22 and back surface 24 converge toward each other to form knife edge 26. The convergence is such that front surface 22 and back surface 24 are progressively farther apart at positions progressively farther from knife edge 26, which imparts strength to projections 20.

Knife edge 26 of projection 20 extends in an arc from main surface 19, through the distal end portion of the projection, and back to main surface 19. Knife edge 26 is a curved sharp edge, fully capable of cutting even very hardened cue tip materials. This preferred full arcing configuration helps projection 20 deeply puncture hardened cue tips with ease.

Figure 6:
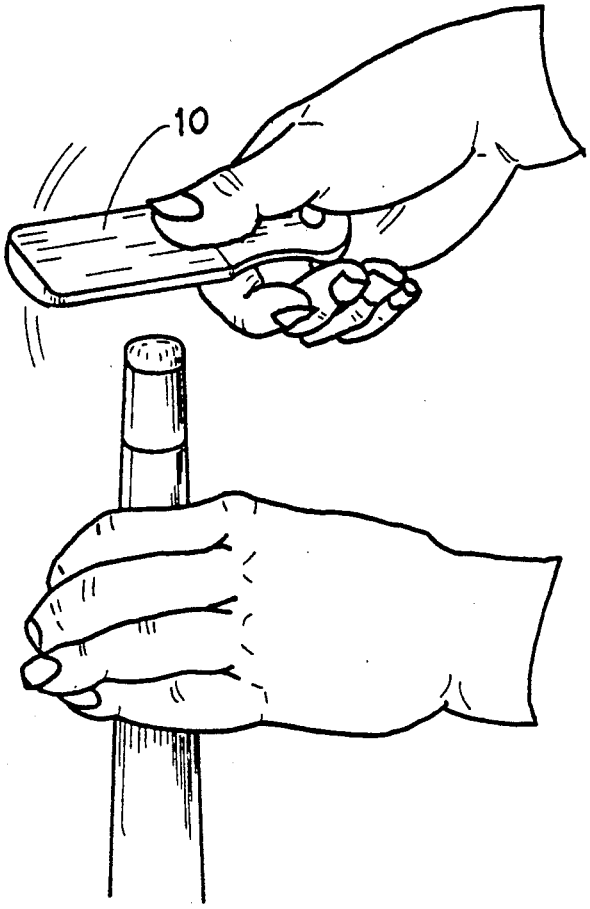
FIG. 6 is view of a person practicing the method of this invention.

FIG. 6 illustrates the method of this invention. Cue tip dressing device 10 is held in the hand of the user with the index finger generally surrounding narrowed portion 16. The thumb of the user can be applied as necessary to the back of base 14 to apply increased pressure during the cue tip impacting operation. The wrist of the user swivels to cause projections 20 on base 14 to strike the hardened cue tip.

The device is not used by rubbing it across the cue tip. Its use is by striking or tapping. Such method imparts a pattern of punctures on the hardened cue tip, which softens and restores the tip without excessive removal of material. This also prepares the tip to better accept and hold chalk.

Many variations can be made in the device of this invention. These can include, among other things, changes in the configuration of convex main surface 19, changes in the configuration of projections 20, and changes in grip handle 20.

While the principles of this invention have been described in connection with specific embodiments, it should be understood clearly that these descriptions are made only by way of example and are not intended to limit the scope of the invention.

I claim:

1. A method for dressing a hardened cue tip comprising:

supporting a cue stick with its hardened cue tip facing generally upwardly;

striking downwardly on the hardened cue tip, in along the axis of the cue tip, with an impact tool having a base with a main surface and a plurality of projections extending from the main surface, each projection having front and back surfaces converging to a convex knife edge which forms a distal end portion of the projection to create a pattern of punctures on the cue tip, said impact tool having a handle extending away from the base in the direction defined by said main surface; and applying chalk in the normal manner to fill the punctures thus created, whereby a pattern of punctures is created on the cue tip without substantial material removal or significant modification of the convex contour of the tip.

2. The method of claim 1 wherein the front and back surfaces of each projection are progressively farther apart at positions progressively more remote from the convex knife edge, thereby imparting strength to the projections and substantial volume to the punctures.

3. The method of claim 1 wherein the convex knife edge extends from the main surface through the distal end portion and back to the main surface.

4. The method of claim 3 wherein the front and back surfaces and progressively farther apart at positions progressively more remote from the convex knife edge, thereby imparting strength to the projections and substantial volume to the punctures.

5. The method of claim 1 wherein the front and back surfaces are both angled with respect to the main surface in a direction toward the grip handle, whereby the projections have undercut profiles oriented toward the grip handle.

6. The method of claim 5 wherein the convex knife edge extends from the main surface through the distal end portion and back to the main surface.

7. The method of claim 6 wherein the front and back surface are progressively farther apart at positions progressively more remote from the convex knife edge, thereby imparting strength to the projections and substantial volume to the punctures.

* * * * *